US005525969A

United States Patent [19]

LaDue

[11] Patent Number: 5,525,969

[45] Date of Patent: Jun. 11, 1996

[54] MONITORING DEVICE FOR LOCATION VERIFICATION

[76] Inventor: Christoph K. LaDue, 1143 12th St. Apt. #5, Santa Monica, Calif. 90403

[21] Appl. No.: 524,972

[22] Filed: Sep. 8, 1995

Related U.S. Application Data

[63] Continuation-in-part of Ser. No. 416,483, Apr. 4, 1995, abandoned, which is a continuation of Ser. No. 55,806, Apr. 30, 1993, abandoned, which is a continuation-in-part of Ser. No. 884,902, May 18, 1992, abandoned.

[51] Int. Cl.[6] ..... G08B 23/00

[52] U.S. Cl. ..... 340/573; 235/492; 283/85

[58] Field of Search ..... 340/568, 571–573, 340/825.31, 825.32, 650–651, 600, 687; 235/488, 492, 494, 462, 468; 379/38, 40; 283/72, 85

[56] References Cited

U.S. PATENT DOCUMENTS

| | | | |
|---|---|---|---|
| 4,202,491 | 5/1980 | Suzuki | 235/491 |
| 4,262,284 | 4/1981 | Stieff et al. | 340/568 |
| 4,537,150 | 8/1985 | Bowers | 119/14.17 |
| 4,684,932 | 8/1987 | Kupec et al. | 340/564 |
| 4,843,377 | 6/1989 | Fuller et al. | 340/573 |
| 4,885,571 | 12/1989 | Pauley et al. | 340/573 |
| 4,918,432 | 4/1990 | Pauley et al. | 340/573 |
| 4,924,211 | 5/1990 | Davies | 340/573 |
| 4,980,671 | 12/1990 | McCurdy | 340/568 |
| 5,006,830 | 4/1991 | Merritt | 340/573 |
| 5,032,823 | 7/1991 | Bower et al. | 340/568 |
| 5,075,670 | 12/1991 | Bower et al. | 340/573 |
| 5,103,474 | 4/1992 | Stoodley et al. | 340/573 X |
| 5,109,153 | 4/1992 | Johnsen et al. | 235/468 |
| 5,117,222 | 5/1992 | McCurdy et al. | 340/573 |
| 5,171,976 | 12/1992 | Bone, Jr. | 235/375 |
| 5,218,344 | 6/1993 | Ricketts | 340/573 |

*Primary Examiner*—Thomas Mullen
*Attorney, Agent, or Firm*—Jeffrey A. Hall

[57] ABSTRACT

A monitoring device useful in home arrest, identification, and surveillance activities, including a monitoring member communicatively linked to a remote communicator. The monitoring member includes a barcode strip secured therein. The monitoring member may be secured to an animate or inanimate object by a strap including a plurality of charged and uncharged conductors therein. The barcode is either printed on or covered by a photo-sensitive material, and a photo-flash element is positioned in proximity to the barcode. When the monitoring member is severed from the animate or inanimate object the photo-flash element is activated thereby altering the photo-sensitive material and obscuring the barcode. The photo-flash element is preferably energized by a battery.

2 Claims, 4 Drawing Sheets

MONITORING DEVICE FOR LOCATION VERIFICATION

RELATED APPLICATIONS

This application is a continuation-in-part of Ser. No. 08/416,483 filed April 4, 1995abandoned, which is a continuation of Ser. No. 08/055,806 filed Apr. 30, 1993, abandoned, which is a continuation-in-part of Ser. No. 07/884,902, filed May 18, 1992, now abandoned.

BACKGROUND OF THE INVENTION

1. Field of Invention

This invention relates to monitoring devices and systems, and more particularly to monitoring devices and systems for community custodial monitoring and remote surveillance.

2. Description of the Related Art

The present invention relates to monitoring devices and in particular to monitoring devices useful in the home attest field and related remote monitoring applications. Most prior art home-community electronic arrest systems have developed around the use of radio frequency transmission signals. Such devices and systems are used to essentially track and verify the location of a person to which the device is attached. The majority of such devices and systems are interlinked with a central monitoring station that either tracks the monitored person directly with radio signal telemetry or, a remote communicator is placed in the monitored persons home that is interfaced with the telephone system that signals the central station when the person is at home. Usually a curfew period is set whereby the monitored person is not permitted to leave the confines of his house, and any attempt to do so sets off an alarm in the communicator and the central station is notified via the telephone lines.

Typically such monitoring devices are provided as wrist or leg devices which are placed on the monitored person by riveting or other mechanical fastening means to insure permanent placement, and any attempt to remove or tamper with the unit will set off a tamper frequency, that is, some form of signal transmitted to a remote monitor. Additionally, such devices typically have a strap that is made of a polymer plastic that contains conductors which if cut or pulled apart set off a tamper frequency. Inside the strap are conductors that create a circuit loop that if severed trigger anti-tamper transmission frequencies thereby alerting the authorities.

It is also common, in prior devices, to provide a case that contains the radio transmission circuitry on the wrist or leg device which is activated if the case is either opened or destroyed. When activated, a tamper or alarm frequency is initiated, and if the transmission ceases all together, the remote communicator sends a romper or an alarm status signal to the central monitoring station via the telephone lines. Central monitoring station staff personnel then notify the appropriate authorities of the violation of the monitored person.

Another genre of prior home monitoring devices utilize radio transmitting devices with remote communicators without transmitting a signal to a distant location to monitor the location or condition of the device. Rather such devices utilize a telephone call back system where a computer dialing system calls the monitored persons home, the phone rings and the person answers, hangs up, and inserts a wrist or leg device into the communicator. The communicator then sends a verification signal back to the central monitoring station. If there is no response when the central station calls, the monitored person is in violation and such status is recorded by the central station computer. Such wrist and leg devices typically transmit a low level radio frequency that transmits in response to the call back cue.

All such prior monitoring devices suffer significant problems which have limited their applicability and usefulness. For example, all such prior devices constantly transmit a radio signal which requires a constant supply of power. All such prior art home attest devices and systems therefore have used and required a battery power supply, and since batteries only maintain a peak performance level for a short period of time before the power curve drops and fluctuates, significant errors and inefficiencies occur. Since such radio transmission devices require a significant amount of power to perform efficiently and accurately, such limitations greatly limit the usefulness of prior devices and systems. Moreover, when battery power drops, false tamper or alarm signals are sometimes activated. Additionally, if the monitored person walks near a washing machine or any other device which generates a magnetic field, the transmission signal of such devices gives off a tamper status frequency, and in some cases ceases transmission all together.

Such prior devices and systems are further limited by the ease of creating counterfeit signals, such as created using garage door transmitters, which fool the remote communicator into verifying the monitored persons presence at a particular location, when in fact, the person is elsewhere. Such limitations, coupled with the false tamper signals previously discussed, create a logistical and custodial nightmare in the management of such devices and systems.

Accordingly, it is the primary object of this invention to provide an improved monitoring device for use in home arrest, monitoring, identification, and security applications which is extremely reliable, efficient, tamper-proof, easy to monitor, and inexpensive to manufacture and apply.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, a monitoring device is provided, comprising: a monitoring member including means for securing said monitoring member to an animate or inanimate object, the monitoring member is communicatively linked with a remote communicator; a barcode strip operably secured within the monitoring member; detection means for detecting severance of the monitoring member from said animate or inanimate object; and energizing means for activating said detection means when the monitoring member is severed or removed from said animate or inanimate object.

The detection memos preferably includes a photo-flash element operably secured within said monitoring member so that when the means for securing the monitoring member to an animate or inanimate object is severed or removed from said animate or inanimate object the photo-flash element is activated thereby altering photo-sensitive material which the barcode is encoded on or which covers the barcode. The barcode strip may be provided by conventional barcode means, by magnetic or other optical indicia, or by a powered liquid crystal display produced by a programmed chip which creates a plurality of barcode characters.

In accordance with the present invention there is also provided a remote-readable monitoring device, comprising: a monitoring member including attachment means for attaching said monitoring member to an animate or inanimate object, the monitoring member being communicatively coupled to a remote monitoring unit; detection means for detecting severance of said attachment means including a plurality of charged and uncharged conductors, said plurality of conductors being operably disposed within said attachment means; and means for maintaining said plurality of conductors at different potentials from one another so that a charged conductor and an uncharged conductor are normally spaced from one another in a sequential fashion so that when a charged conductor contacts an uncharged conductor an electrical current flows activating said detection means.

BRIEF DESCRIPTION OF THE DRAWINGS

The accompanying drawings, which are incorporated in and constitute a part of the specification, illustrate a preferred embodiment of the invention and, together with a general description given above and the detailed description given below, serve to explain the principles of the invention.

DETAILED DESCRIPTION OF THE PREFERRED EMBODIMENTS

Reference now will be made in detail to the present preferred embodiments of the invention as illustrated in the accompanying drawings.

In accordance with the present invention, there is provided a monitoring device for monitoring, identification, and surveillance applications, comprising: a monitoring member including means for securing said monitoring member to an animate or inanimate object, the monitoring member is communicatively linked with a remote communicator; a barcode strip operably secured within the monitoring member; detection means for detecting severance of the monitoring member from said animate or inanimate object; and energizing means for charging a plurality of conductors operably secured within the monitoring element.

Figure 1:
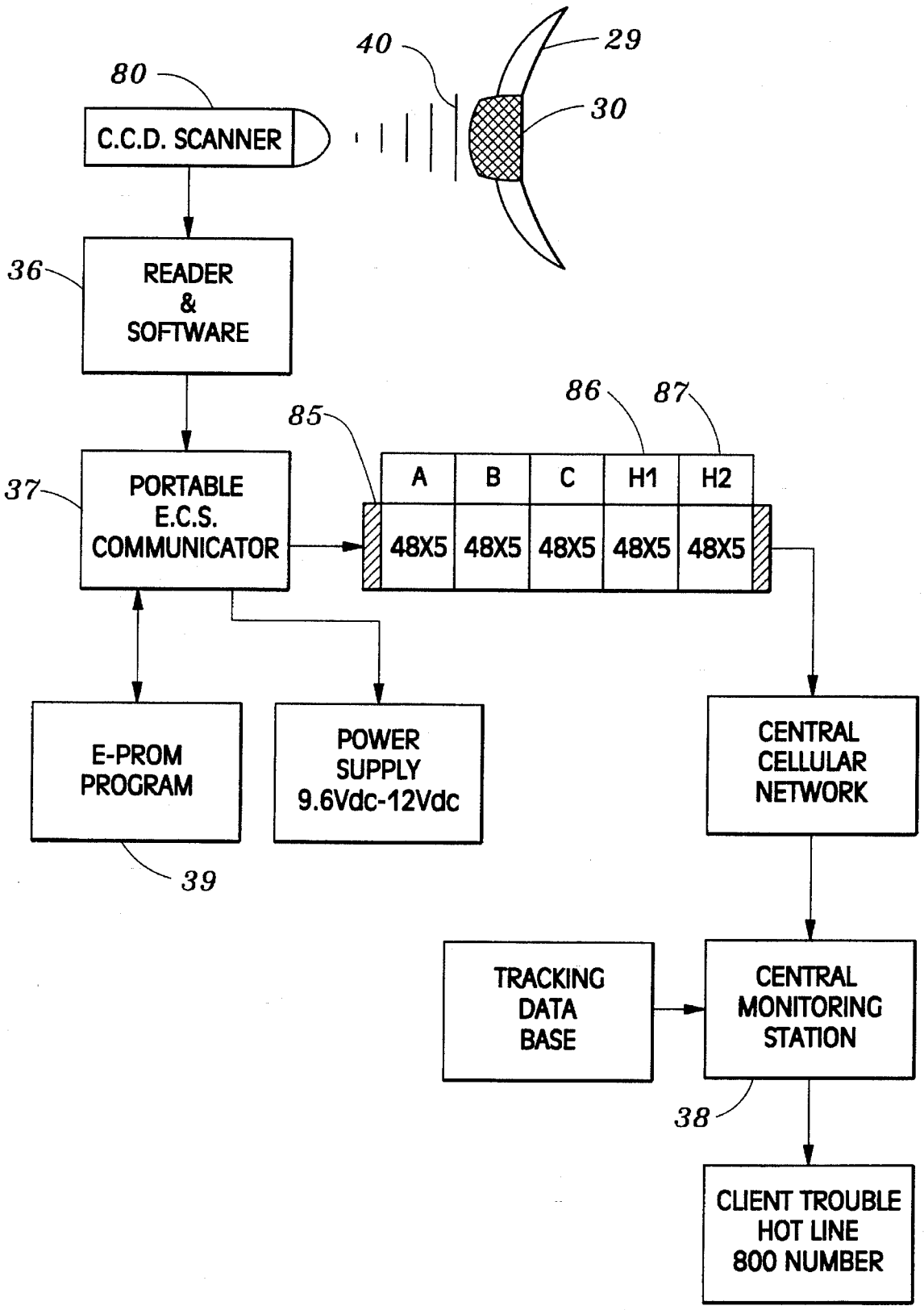
FIG. 1 is a block diagram illustrating the logic flow of the present invention, according to the invention.

In FIG. 1, a logic flow diagram of a preferred embodiment of the invention is shown. Monitoring device 30 comprises monitoring element 31 including means for securing the monitoring member 31 to an animate or inanimate object, such as leg 43 shown in FIG. 3. Means for securing monitoring member 10 preferably comprise an elongated strap 29 composed at least in part of an electrical insulating material, such as rubber, thermoplastic, or other polymeric electrically insulating material. Strap 29 preferably includes a multiconductor ribbon cable covered by a plastic polymer. Monitoring member 31 is communicatively linked with a remote communicator 37 operably interfaced with scanner 80 and barcode reader 36, preferably with an infrared read pen for reading barcode 40. Remote communicator 37 contains the circuitry, well known in the art, necessary to transmit verification data to a central monitoring station 38. For example, the remote communicator 37 is programmed with a monitored persons vital statistics, such as name, address, booking number, custody level, etc. located in E-Prom program 39. Each such remote communicator is programmed to accept only one barcode format and one assigned number which is located in monitoring member 31 in identifiers 34 of encoded barcode strip 40. Barcode reader 36 is preferably programmed to accept the barcode format unique to identifiers 34 of barcode 40. Preferably no other barcode system such as those used for merchandise price tags, card lock technology, or the like, will be recognized by barcode reader 36 and remote communicator 37.

In FIG. 1 an electronic capture system (ECS) communicator 37 is shown configured for transmitting status information through the cellular telephone control channel network. In this preferred embodiment barcode data is converted to 10 kbps modulated 48 bit word strings contained within a normal reverse control channel (RECC) multiword string 85, that is normally utilized by conventional phone systems such as the American Mobile Phone System (AMPS) and Total Access Communications Systems (TACS) cellular systems. In this way ECS communicator 37 is configured as a portable wireless system that transmits its status information in the bet structure of two additional 48 bit RECC words H186 and H2 87. This data is captured and read at the central monitoring station 38 and processed. Once processed, the ECS communicator can be instructed to perform various monitoring functions such as surveillance, tracking, and alarm, by sending command data to the communicator by way of a paging network, or a cellular system forward control channel.

Figure 8:
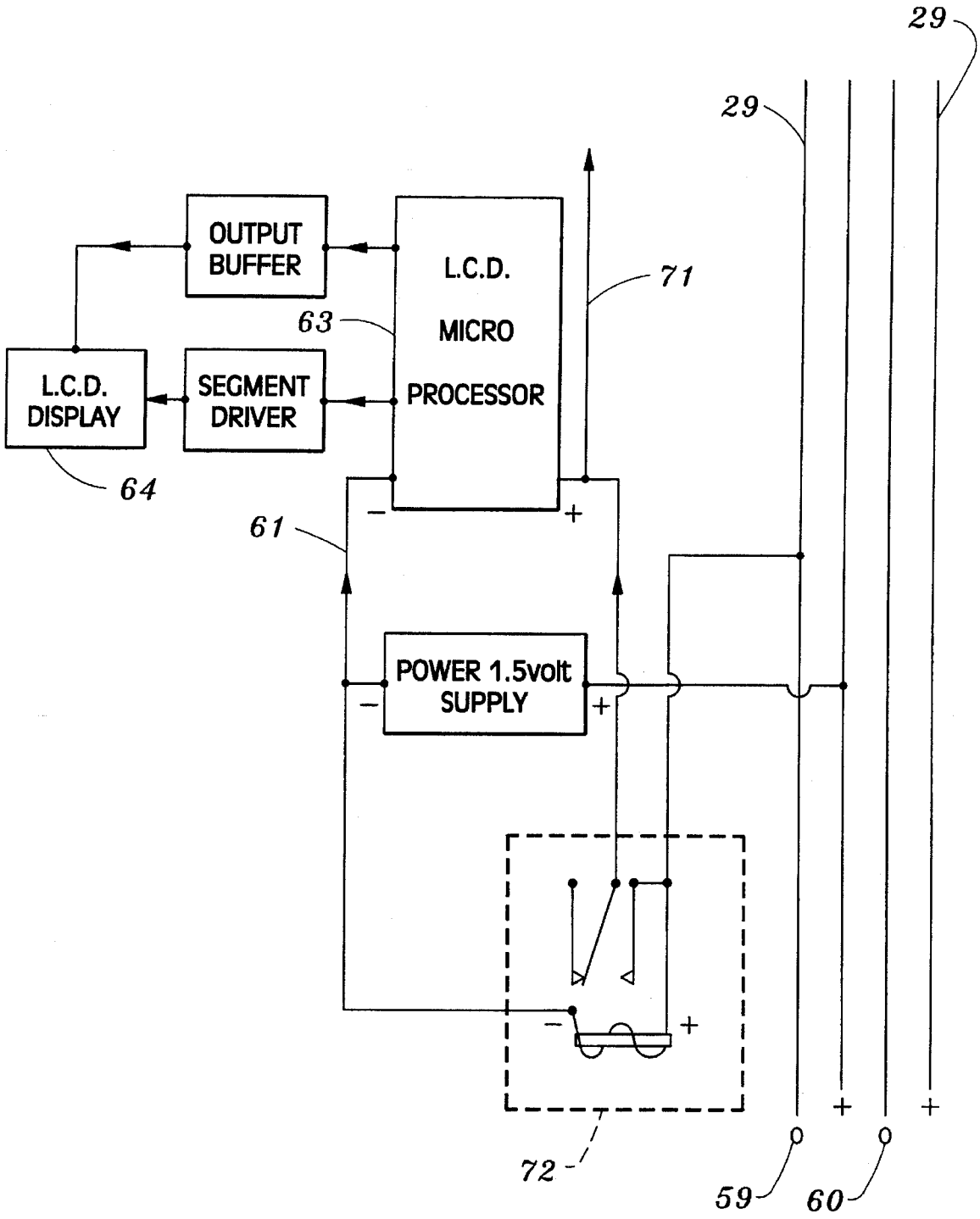
FIG. 8 shows a block diagram illustrating the schematic of a LCD provided barcode, according to the invention.

Barcode 40 may be provided by conventional barcode technology well known in the art, including magnetic or other optical indicia, and is preferably printed on a photo-sensitive material 35, such as thermo-sensitive paper, film, infrared film, or the like, and encased in housing 41. It is also preferable to locate a strip of infrared film over the barcode strip to prevent viewing with the naked eye and to prevent duplication with a photo-copier so that counterfeiting the barcode strip is impossible. Alternatively, barcode 40 may be partially or completely covered with photo-sensitive material 35, or enclosed within housing which is partially or completely covered with photo-sensitive material 35. In an alternative embodiment of the invention, barcode 40 may be provided by a powered liquid crystal chip display 64 produced by programmed chip 63 which creates a plurality of barcode characters, shown as a block diagram schematic in FIG. 8, with circuits 61 and 62 communicatively coupled to strap 29 with conductors 59 and 60. The liquid crystal displayed barcode can be rendered unreadable simply by cutting or removing monitoring member 31 or cutting or removing strap 29 from monitoring device 30 thereby destroying the circuitry created in strap 29 by a plurality of charged and uncharged conductors shown in FIG. 4 and 5 as charged conductors 12, 16, 18, 20, and 22 and uncharged conductors 14, 15, 17, 19, and 21, and destroying a ROM chip responsible for projecting the barcode image, thereby assuring that the monitoring device is not reusable after such tampering. Also shown in FIG. 8, is data for pen 71 and relay 72. Relay 72 is normally opened, but is activated and permanently closed upon cutting, severance, or other tampering of strap 29 or monitoring member 31.

Figure 4:
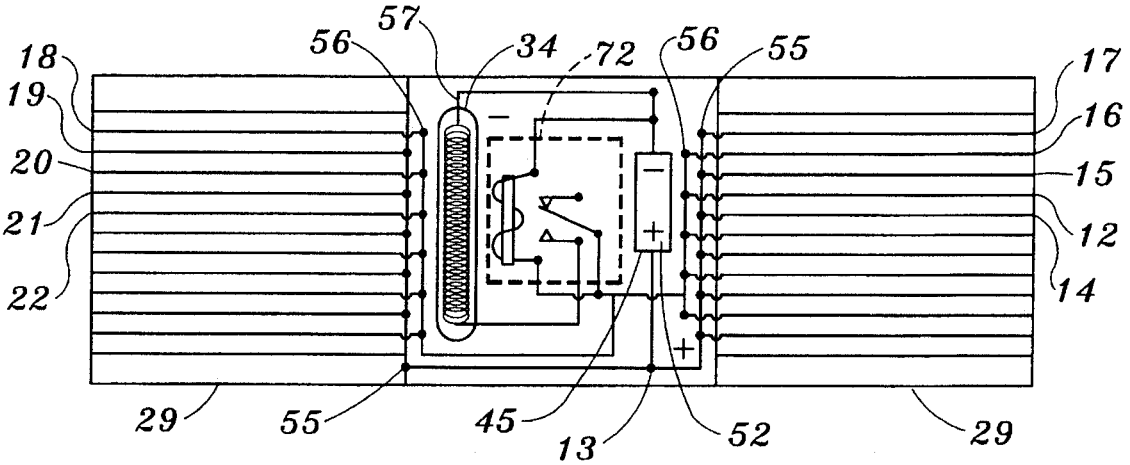
FIG. 4 shows a top cut-away view of such monitoring device, according to the invention.

Detection means for detecting severance of the monitoring member 31 from the animate or inanimate object comprise, in the preferred embodiment of the invention, a photo-flash element 34, which may be a filament, a nicron wire, heat sensitive wire, or any other photo-conductive material operably secured within the monitoring member 31 so that when elongated strap 29 or monitoring member 31 is severed or removed from the animate or inanimate object photo-flash element 34 is activated emitting light and thereby altering photo-sensitive material 35 and obscuring barcode 40. As seen in FIGS. 3 and 4, monitoring device 30 contains photo-flash element 34 that when energized or charged by energizing means, preferably battery 52, creates heat and/or light sufficient to obscure barcode strip 40, and thereby rendering it unreadable, by altering photo-sensitive material 35. For example, if an attempt is made to remove monitoring member 31 from the animate or inanimate object, such as leg 43 of a monitored person shown in FIG. 3, a plurality of charged conductors 12, 16, 18, 20, 22 and uncharged conductors 14, 15, 17, 19, and 21 are operably coupled creating a circuit which energizes photo-flash element 34, best seen in FIG. 2. Conductors 12, 16, 18, 20, and 22 are preferably charged as a group so that the charged conductors as a group are energized with positive voltage from battery 52 supplied by primary conductors 9 and secondary-bridging conductors 55. The circuit to photo-flash element 34 is completed if strap 29 or monitoring member 31 is cut, severed, or removed from leg 43, such as with scissors 44 or other any other severing device because a charge is then passed to uncharged conductors 14, 15, 17, 19, and 21. Now the uncharged conductors become charged conductors, and the current is passed to bridging- conductors 56 and routed to a lead conductor 13 which activates photo-flash element 34 because the positive voltage meets a negative current supplied by conductor 57 which is preferably directly connected to a negative battery housing conductor 45, best seen in FIG. 4. This creates an arc in photo-flash element 34 which supplies the heat and light which alters photo-sensitive or heat-sensitive material 35 thereby obscuring barcode 40. Alternatively, a small quantity of reactive chemical, preferably a caustic chemical such as sulfuric acid, sodium hydroxite, hydrochloric acid, or the like, may be proximately positioned next to barcode 40, and such chemical released when strap 29 or monitoring member 30 is cut or severed from the object to which it is attached.

Referring now to FIG. 3, strap 29 is preferably provided with attachment means, preferably clamp 32, which may be steel or other durable resilient material and covered with a plastic. It is also useful to apply a hot gluing process, using adhesive 33, as shown in FIG. 3, so as to create a continuous strap or band. This provides a very strong band which must be cut or severed to be removed from an object, which of course is very difficult because the strap or band is so strong. In the event that strap 29 is pulled enough to separate, the alternately charged conductors, 12, 14, 16, 18, 20 and 22 will come in contact with uncharged conductors 14, 15, 17, 19, and 21 creating the complete circuit necessary to activate photo-flash element 34 thereby obscuring photo-sensitive material 35 making barcode 40 unreadable. When the monitored person, for example, is required to verify his or her location to the central monitoring station a violation will be noted because barcode 40 is no longer readable.

Figure 2:
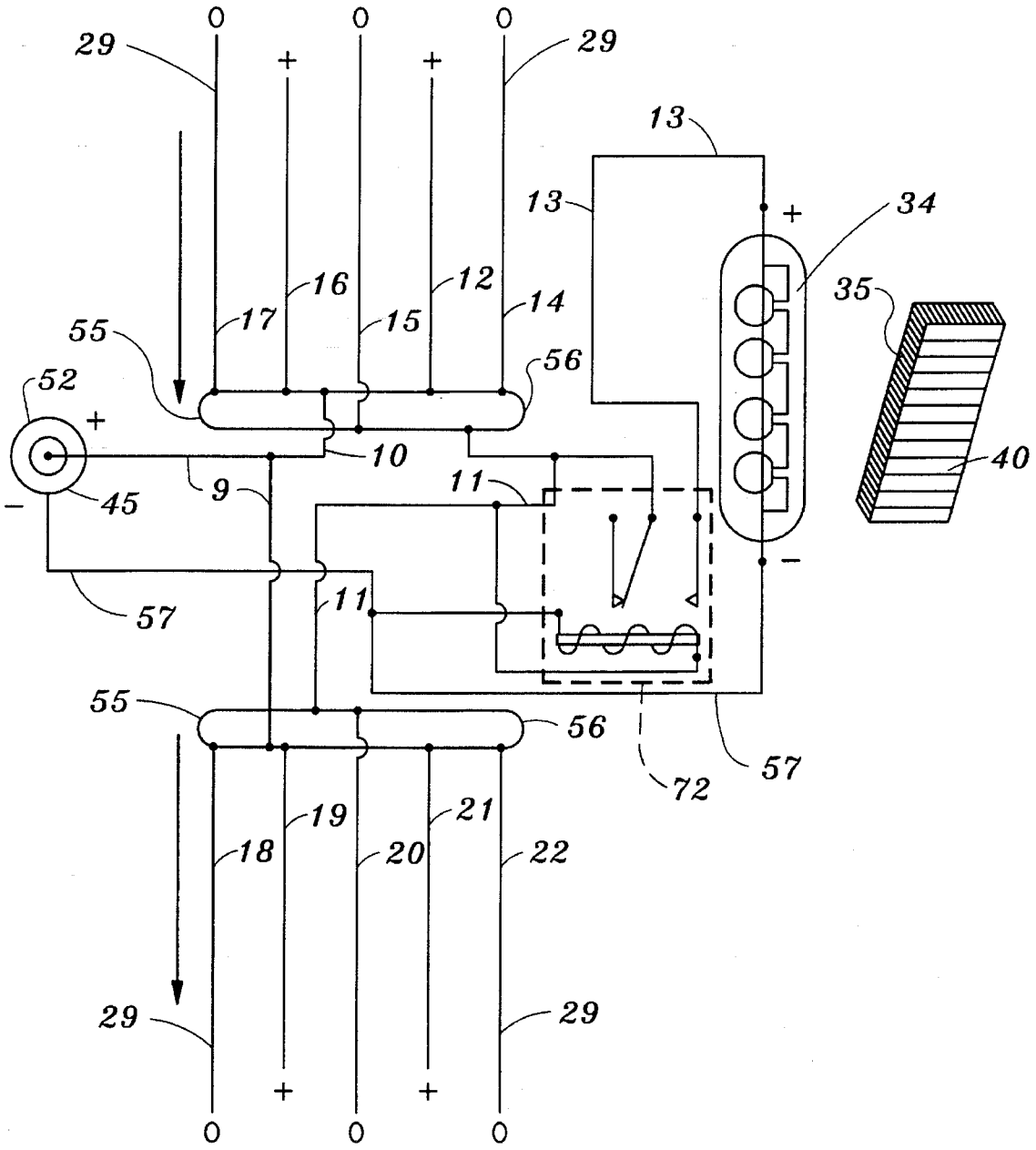
FIG. 2 is a schematic illustration of the monitoring device, according to the invention.
Figure 3:
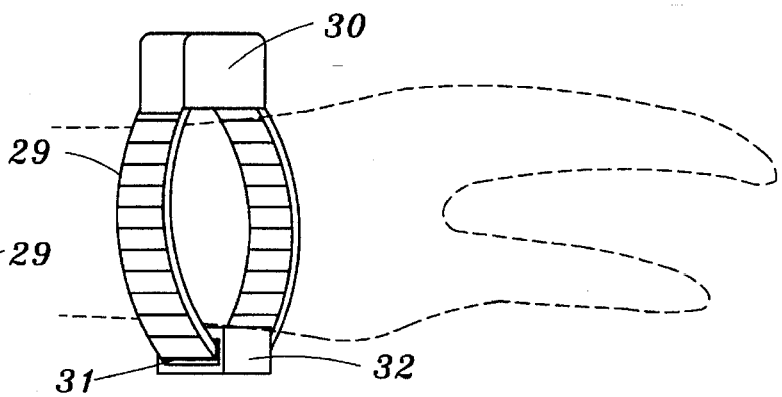
FIG. 3 shows the monitoring device adapted for wrist or leg attachment, according to the invention.

Referring now to FIG. 2, a schematic illustration of the circuitry of the preferred embodiment of the invention is shown with photo-flash element 34, battery 52, and conductors 12, 14, 15, 16, 18, 19, 20, 21, and 22 operably coupled together, and which are preferably positioned in strap 29.

Figure 7:
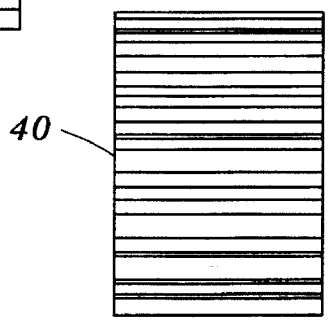
FIG. 7 shows a barcode strip, according to the invention.
Figure 5:
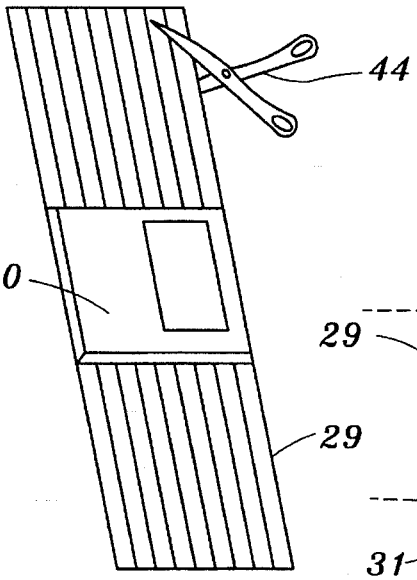
FIG. 5 shows a top perspective view of such monitoring device, according to the invention.

In FIG. 5, monitoring device 30 is shown with housing 41, cover 27, and strap 29. Scissors 44 are shown for illustrative purposes only in act of cutting strap 29, which would activate detection means as previously described. FIG. 7 shows a barcode printed on photo-sensitive material 35. Note that photo-sensitive material 35 may be alternatively provided partially or completely covering bar code 40.

Figure 6:
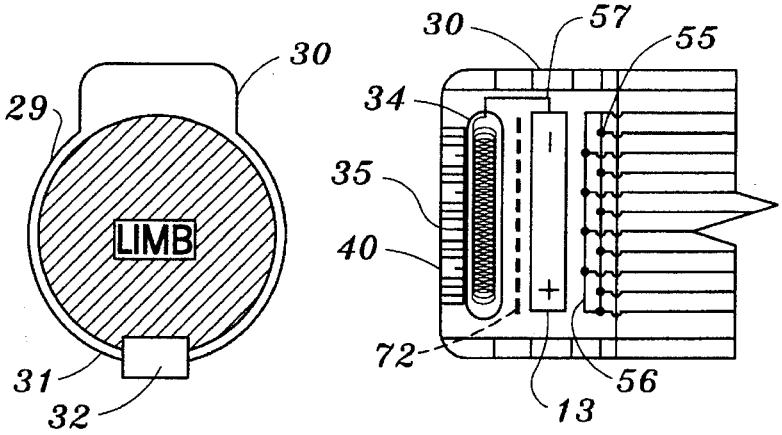
FIG. 6 shows a sectional view of the monitoring member, according to the invention.

As shown in FIG. 6, monitoring device 30 is shown with monitoring member 31, barcode 40, and photo-flash element 34 proximately located thereto. Cover 27 and strap 29 are operably secured thereto. Battery 52 may be provided as a very small battery as extremely low energy demands are made on it. It is preferably maintained in the standby mode, and is only activated if strap 29 or monitoring member 31 is cut or severed from the object to which it is attached, and therefore has a very long life of at least two to five years. Housing 41 is preferably provided in a small size no bigger than a wristwatch so as to be convenient, unobtrusive, and discreet. Housing 41 and band 26 are preferably sealed and waterproofed, and provided as a unitary body, with plastic and a hot gluing with adhesive applied thereto, as previously described, and are therefore extremely durable and resistant to wear.

In accordance with the present invention there also is provided a remote-readable monitoring device, comprising: a monitoring member including attachment means for attaching said monitoring member to an animate or inanimate object, the monitoring member being communicatively coupled to a remote monitoring unit; detection means for detecting severance of said attachment means including a plurality of charged and uncharged conductors, said plurality of charged and uncharged conductors being operably disposed within said attachment means; and, means for maintaining said plurality of conductors at different potentials from one another so that a charged conductor and an uncharged conductor are normally spaced from one another in a sequential fashion so that when a charged conductor contacts an uncharged conductor an electrical current flows activating said detection means.

In this embodiment, the plurality of charged conductors are shown as 12, 16, 18, and 22; and the plurality of uncharged conductors are shown as 14, 15, 17, 19, and 21 operably positioned in strap 29 as previously described. The plurality of conductors are preferably composed of a metal. Battery 52 provides the means of maintaining the plurality of conductors at different potentials from one another. The conductors are preferably spaced within strap 29 in a sequential fashion so that when a charged conductor contacts an uncharged conductor, for example, if strap 29 is severed or cut from the object to which it is attached, an electric current flows in band 29 activating detection means, which are preferably photo-flash element 34 as previously described, and which when activated alters photo-sensitive material 35 and thereby obscures barcode 40.

Barcode 40 may, in this embodiment, also be provided by powered liquid crystal display 64 produced by programmed chip 63 which creates a plurality of barcode characters. Chip 56 is communicatively coupled to said plurality of charged and uncharged conductors. The plurality of conductors are preferably separated from one another by an electrical insulating material, such as rubber, thermoplastic, urethane, or other polymeric material.

In operation and use, the monitoring device 30 is extremely efficient, reliable, durable, and inexpensive to manufacture. It may be conveniently provided in a small size so that it is unobtrusive, while providing extremely accurate monitoring. It is also easily adaptable with prior central monitoring systems.

For example, monitoring device 30 may be attached to the wrist or leg of a person under house arrest. Such monitored persons are subject to designated curfew times set by custodial staff. If the monitored person is to check in at 6:00 P.M. when he or she arrives home, such person simply walks up to the remote communicator 37 which may be located in his or her home, reads the barcode with reader 36, and communicator 37 sends this verification data over the telephone line to central monitoring station 38. Central monitoring station 38 records the persons booking number, the barcode number, the time and the date of the check in. Signal means, such as a light emitting diode may be provided on the remote communicator which is wired to light up when all of the information is recorded by the central monitoring station 38. The monitored person then knows that he or she has checked in and such information recorded. Once the light emitting diode is activated, the monitoring station sends a tone back to remote communicator 37 and the telephone is released to normal operation and usage.

Remote communicator 37 may be provided with a circuit which limits telephone activity in the monitored person's home during a designated check in time. That is, any telephone extensions that may be used by other people or the monitored person in the residence will be cut off and the remote communicator takes over during a designated time interval. When the verification is completed, the telephone system is released back to normal operation. The monitored person may also, of course, be subject to random calling for verification at any time. Such methodology enforces a behavior modification on the part of the monitored person by consistent and reliable operation of monitoring device 30 and the verification methodologies which may be employed using the remote communicator 37 communicatively linked to the central monitoring station 38. If monitoring member 31 or strap 29 is severed or cut from the person or object to which it has been attached verification is impossible because barcode 40 has been obscured and made unreadable. In the home arrest application, such lack of verification leads to immediate notification of the appropriate custodial staff.

It is readily apparent that the monitoring device 30 may be used in a wide variety of applications including monitoring of people, animals, and inanimate objects; surveillance applications; and identification of people, animals, inanimate objects, and the like. For example, monitoring device 30 may be used as a security tag in either public or private institutions. In such application monitoring device 30 could be used as tag on the clothing of the person entering the secured facility. The clothing could function as an insulator that separates a charged clamp from an uncharged contact with photo-flash element 34 positioned within the body of the tag. Monitoring device 30 may be used to track numerous animate objects such as children, pets, animals, farm animals, wildlife monitoring, hospital patients, and the like. Or monitoring device 30 may be used to track merchandise in warehouses, baggage, mail, or the like.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the applicant's general inventive concept.

What is claimed is:

1. A monitoring device, comprising:

a monitoring element including means for securing said monitoring element to an animate or inanimate object, the monitoring element being communicatively linked with a remote communicator;

a barcode strip printed on photo-sensitive material operably secured to the monitoring element;

detection means for detecting severance of the monitoring element from said animate or inanimate object, said detection means including a photo-flash element operably secured to said monitoring element so that when said means for securing said monitoring element to said animate or inanimate object is severed or removed from the animate or inanimate object said photo-flash element is activated thereby altering said photo-sensitive material and obscuring said barcode strip; and energizing means for charging a plurality of conductors secured within said monitoring element.

2. A monitoring device for location verification of an animate or inanimate object, comprising:

a monitoring element including attachment means for attaching said monitoring element to said animate or inanimate object, the monitoring element being communicatively coupled to a remote monitoring unit;

detection means for detecting severance of said attachment means, said detection means including a barcode on photo-sensitive material being proximately positioned to a photo-flash filament and a plurality of charged and uncharged conductors; said plurality of conductors being operably disposed within said attachment means so that when said attachment means are severed said photo-flash element is activated, thereby altering said photo-sensitive material and obscuring the bar code; and means for charging the plurality of conductors operably secured within the monitoring element.

* * * * *